US006968069B1

(12) United States Patent
Zhao

(10) Patent No.: US 6,968,069 B1
(45) Date of Patent: Nov. 22, 2005

(54) LOW-PROFILE TWEETER WITH LATERAL AIR CHAMBER

(75) Inventor: Zhijun Zhao, Stillwater, OK (US)

(73) Assignee: Stillwater Designs & Audio, Inc., Stillwater, OK (US)

( * ) Notice: Subject to any disclaimer, the term of this patent is extended or adjusted under 35 U.S.C. 154(b) by 17 days.

(21) Appl. No.: 10/752,071

(22) Filed: Jan. 6, 2004

(51) Int. Cl.[7] ..... H04R 25/00
(52) U.S. Cl. ..... 381/345; 381/371; 381/420; 381/430
(58) Field of Search ..... 381/371, 182, 381/186, 412–414, 420, 423, 430, 353, 354, 381/421, 397; 181/144, 145, 147, 129, 166, 181/173, 151

(56) References Cited

U.S. PATENT DOCUMENTS 3,496,307 A * 2/1970 Sotome ..... 381/420
4,239,945 A * 12/1980 Atoji et al. ..... 381/371
4,742,887 A * 5/1988 Yamagishi ..... 181/129
5,844,998 A * 12/1998 Nageno ..... 381/371

OTHER PUBLICATIONS

Danish Sound Technology, Website, Scan-speak brand Tweeter Model No. D2904/600000, Larkspur, CO., on sale prior to the filing date of the above styled application. Print out of website (4 pages) attached as Exhibit A.
Danish Sound Technology, Photographs of Scan-speak brand tweeter Model No. D2904/600000, Larkspur, CO., on sale prior to the filing date of the above styled application. Photgraphs (2 pages) attached as Exhibit B.

* cited by examiner

*Primary Examiner*—Huyen Le
(74) *Attorney, Agent, or Firm*—Mary M. Lee

(57) ABSTRACT

A vented tweeter with a low profile particularly suited for automotive applications where the mounting depth is limited. The tweeter comprises a motor with a central air passage extending through it and a lateral air chamber formed around it. Radial channels on the top of the motor connect the air gap in the motor with the central air passage, and radial channels under the motor connect the central air passage with the lateral air chamber. As the diaphragm oscillates, air can move back and forth between the air gap around the magnet and lateral space outside the motor. This configuration substantially increases the volume of air that can be acted on by the diaphragm without significantly increasing the length of the assembled tweeter or compromising the power of the motor. To enhance the power of the motor, a secondary magnet can be included above the top plate.

26 Claims, 5 Drawing Sheets

LOW-PROFILE TWEETER WITH LATERAL AIR CHAMBER

FIELD OF THE INVENTION

The present invention relates to speaker assemblies generally and, in particular, to tweeters.

BACKGROUND OF THE INVENTION

In the field of automotive sound systems, there is a continuing effort to improve the low range performance of high frequency speakers, or tweeters. Generally, the quality of low range sound in tweeters is enhanced by increasing the air space behind the diaphragm. This can be done by providing an air chamber at the rear of the housing, which extends the length or depth of the speaker. However, this is not a viable design option for tweeters in automotive sound systems because tweeters usually are installed in door panels and dashboards where the available mounting depth is limited.

The present invention provides a design for an automotive tweeter that offers a low profile in combination with improved low range characteristics. This is accomplished by providing an air chamber that is lateral to the motor instead of behind it.

SUMMARY OF THE INVENTION

The present invention comprises a tweeter comprising a housing formed of a rear wall and a sidewall, the sidewall extending forwardly from the rear wall and terminating in an open front end. The rear wall and sidewall form a motor receiving space in the housing. A motor is mounted in the motor receiving space of the housing. The motor comprises a permanent magnet assembly and an annular gap extending around the permanent magnet assembly. The motor is characterized by an air passage extending through it. A diaphragm is movably supported over the open end of the housing and forms a forward air chamber between the motor and the diaphragm. The forward air chamber is continuous with the air passage through the motor and the annular gap around the magnet assembly. A voice coil assembly is movably supported in the annular gap in the motor and operatively engaged with the diaphragm. The voice coil assembly, the motor and the diaphragm are cooperatively adapted to reproduce high frequency sounds.

The tweeter further comprises an air chamber lateral to the motor between the motor and the sidewall of the housing. The lateral air chamber is in communication with the air passage through the motor.

DETAILED DESCRIPTION OF THE PREFERRED EMBODIMENT

Figure 1:
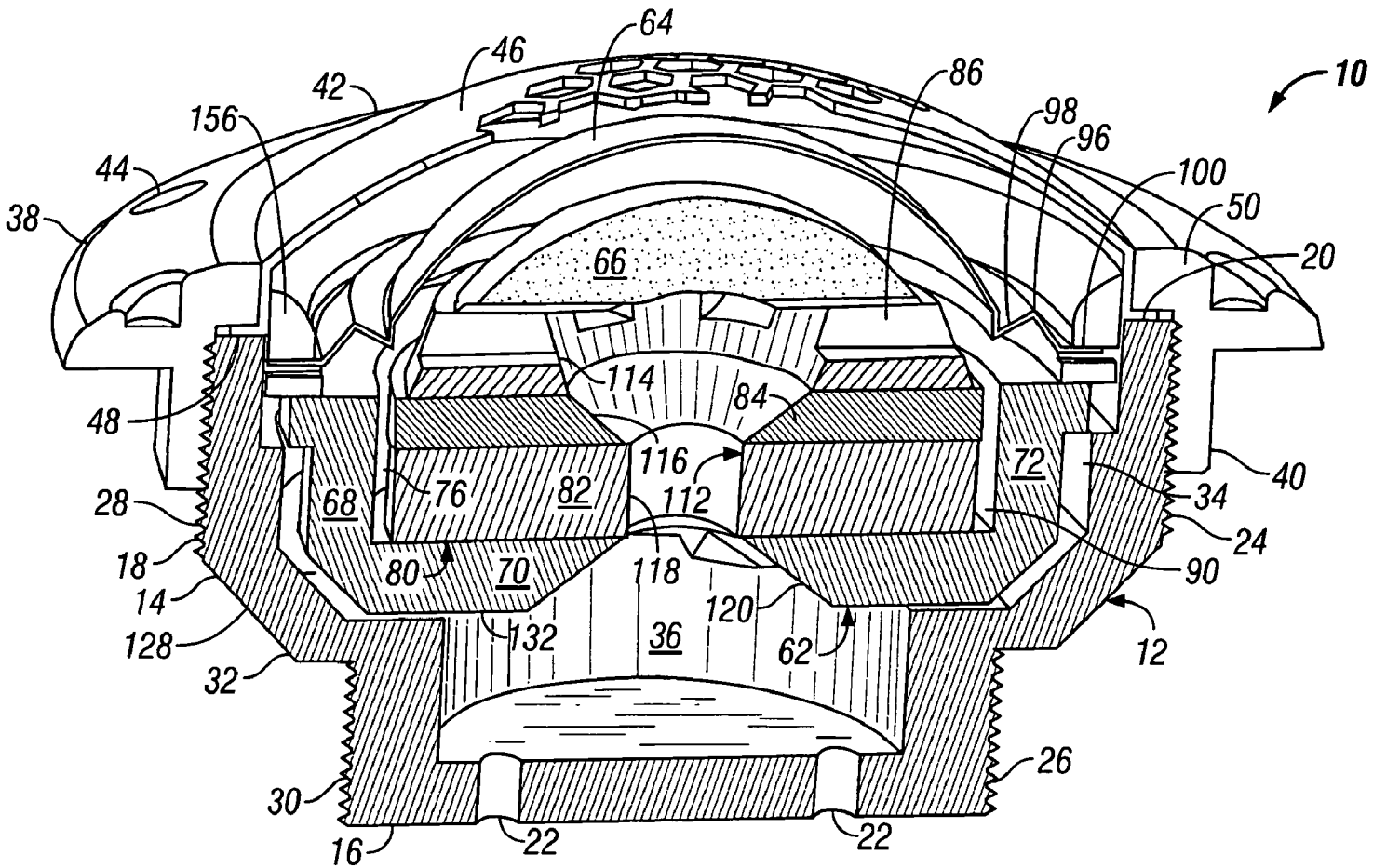
FIG. 1 is a side perspective sectional view of a fully assembled tweeter constructed in accordance with the present invention. The voice coil and leads have been omitted to simplify the illustration.

With reference now to the drawings generally and to FIG. 1 in particular, there is shown therein a tweeter constructed in accordance with a preferred embodiment of the present invention and designated generally by the reference numeral 10. The external components of the tweeter include a housing 12, which receives the internal working components. The housing 12 comprises a body 14 formed by a closed rear wall 16 and a sidewall 18 extending forwardly of the rear wall. As used herein, "forward" and "frontal" refer to the end of the tweeter in which the sound is emitted, and "rearward" and "back" refer to the end of the tweeter opposite the forward or front end. The sidewall 18 terminates in an open front end 20. The rear wall 16 is closed except for small openings 22 for the electrical leads (not shown in FIG. 1).

The body 14 of the housing 12 preferably is formed into two sections, a first body portion 24 forming the forward end of the tweeter 10 and a second body portion 26 forming the rearward end of the tweeter 10. The first body portion 24 has a generally cylindrical shape with external threads 28. The second body portion 26 also preferably is generally cylindrical with external threads 30. In this embodiment, the second body portion 24 is connected to the first body portion by a rearwardly tapering frusto-conically shaped connecting portion 32.

Figure 5:
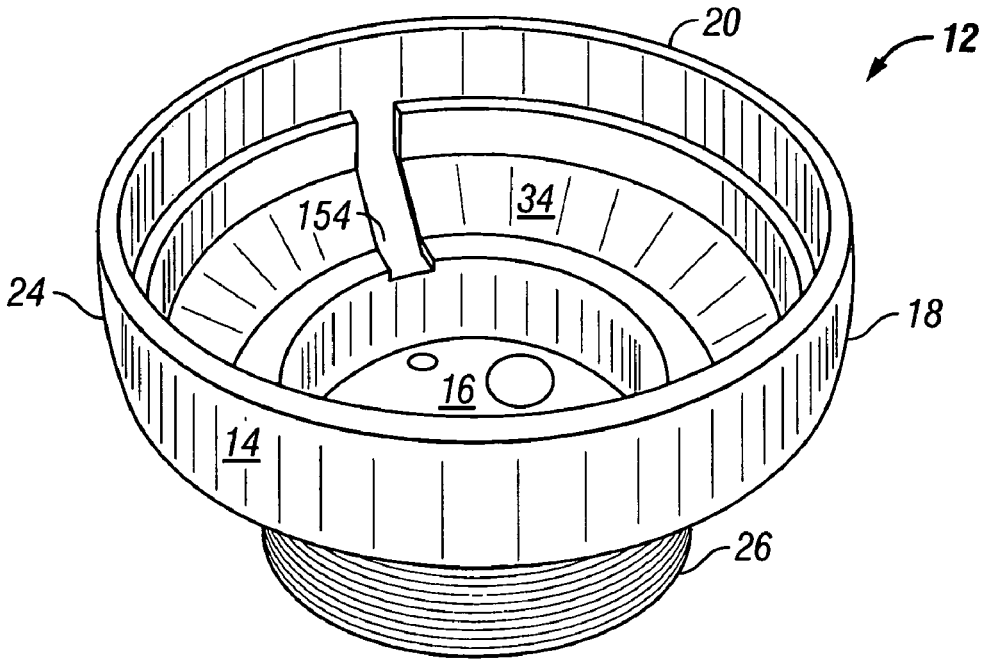
FIG. 5 is a frontal perspective view of the housing of the tweeter.

Internally, the first body portion 24 and the connecting portion 32 form a motor receiving space 34, as is also seen in FIG. 5, discussed hereafter. The second or rear body portion 26 forms a rear air chamber 36. The housing 12 may be integrally formed of plastic or other lightweight, moldable, non-conductive material.

The external components of the tweeter 10 may also include an annular mounting flange 38. The mounting flange 38 comprises a generally cylindrical sidewall 40 internally threaded to engage the threads 28 of the first body portion 24 of the housing 12. A laterally extending flange portion 42 extends outwardly from the sidewall 40. Openings 44 are spaced circumferentially around the flange portion 42 for mounting and removal torque.

Still further, external components of the tweeter 10 include a perforate domed grill 46 sized to cover the open front end 20 of the housing 12. Preferably, the grill 46 includes an edge 48 adapted to be trapped between the open front end 20 of the housing 12 and an inwardly extending shoulder 50 on the mounting flange 38.

As is apparent from FIG. 1, the tweeter has a relatively short depth. For example, in a preferred embodiment shown, the diameter of the diaphragm is 40 mm and the overall length of the assembled tweeter is about 25 mm. This allows the tweeter to be installed in a variety of locations in a vehicle, including the dashboard, the front and rear door panels, and A-pillars.

Figure 2:
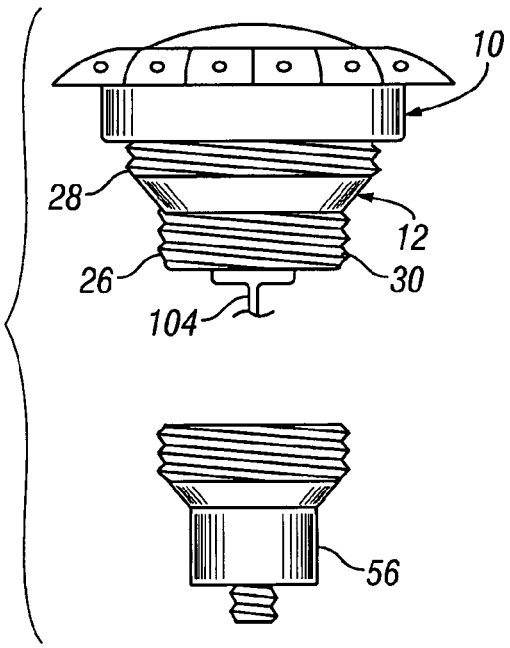
FIG. 2 is an exploded side elevational view of the tweeter in FIG. 1 with a coaxial mounting cup.
Figure 3:
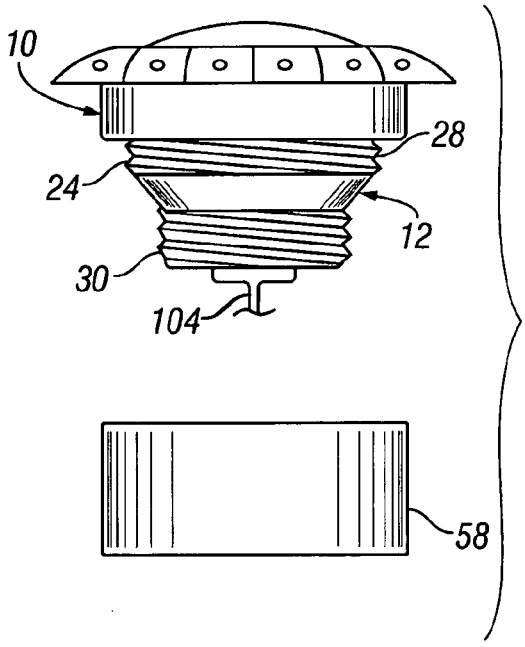
FIG. 3 is an exploded side elevational view showing the tweeter of FIG. 1 with a flush mounting cup.

Preferably, the housing 12 comprises means by which the tweeter 10 can be mounted in the selected environment. As illustrated in FIG. 2, the external threads 30 of the second body portion 26 may be adapted to threadingly engage the internal threads of a coaxial mounting cup 56. This permits the tweeter 10 to be mounted coaxially. Alternately, a flush mounting cup 58 may be used to mount the tweeter 10 by threading the flush mounting cup to the larger diameter first body portion 22, as indicated in FIG. 3. The flush mounting cup 58 allows the tweeter 10 to be mounted into the mounting surface.

Returning to FIG. 1, the main internal or working components of the tweeter 10 comprises a motor 62, a diaphragm 64 and a damper 66 mounted atop the motor under the diaphragm. A voice coil assembly is also included, but is not shown in FIG. 1. The motor 62 generally is sized and shaped to be mounted in the motor receiving space 34 in the housing 12.

The motor 62 preferably comprises a supporting member such as the yoke 68, which may be generally U-shaped. The yoke 68 preferably comprises a back panel 70 and a sidewall 72 extending forwardly of the back panel to form a magnet receiving space 76. The yoke 68 may be integrally formed of conductive metal such as low carbon steel and preferably 1008 grade steel.

Figure 6:
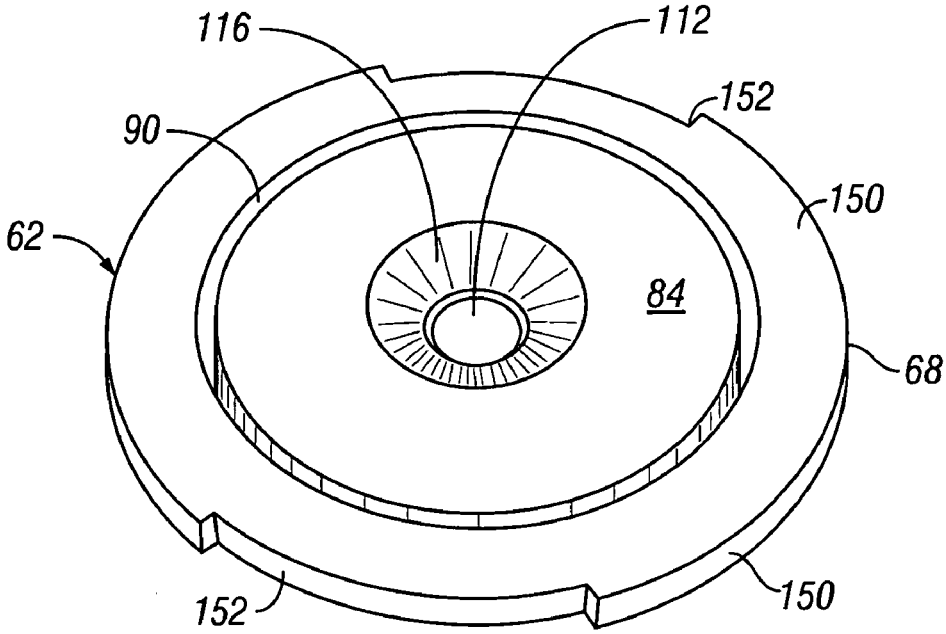
FIG. 6 is a frontal perspective view of the motor with the second permanent magnet removed and top plate positioned over the first or primary permanent magnet.
Figure 7:
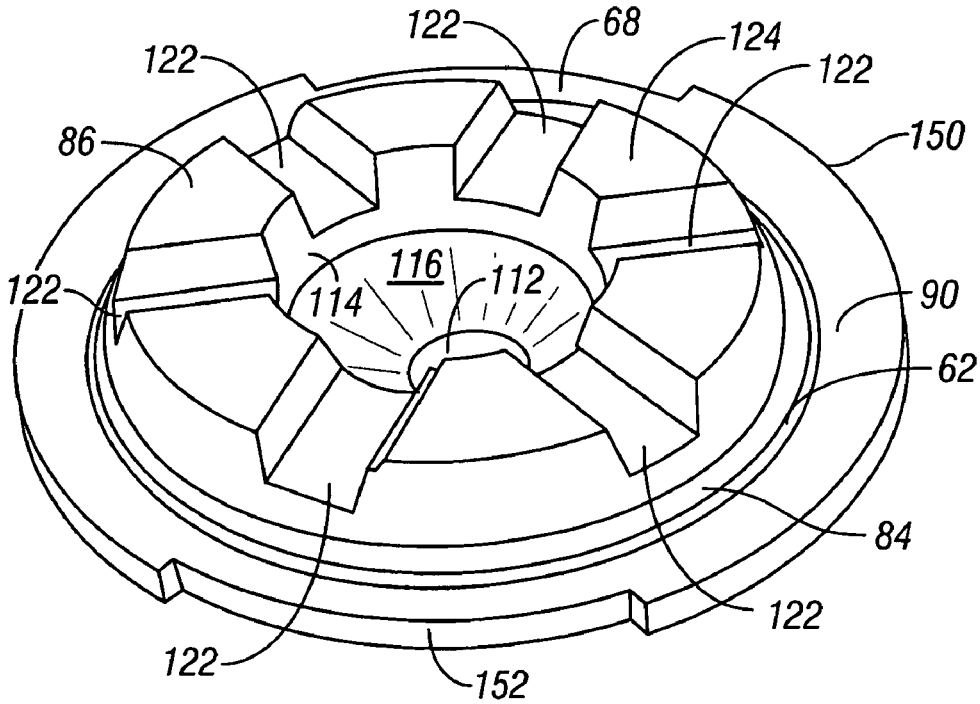
FIG. 7 is a frontal perspective view of the motor showing the second permanent magnet atop the top plate and the radial air channels on the frontal surface of the second magnet.

The motor 62 also includes a permanent magnet assembly 80. The permanent magnet assembly comprises at least a first permanent magnet 82 receivable inside the yoke 68 in the magnet receiving space 76. A top plate 84 is included in the motor 62, the top plate being receivable in the yoke 68 over the first permanent magnet 82, as best seen in FIG. 6. Although the magnet assembly 80 may consist of a single magnet, such as the magnet 82, the preferred magnet assembly further comprises a second permanent magnet, such as the magnet 86. The second permanent magnet 86 preferably is positioned immediately above and resting on the top plate 84, as seen in FIG. 7.

Several different types of permanent magnets may be employed in the motor 62. However, particularly suitable for this purpose are rare earth magnets, and most preferably, the permanent magnets will comprise Neodymium Iron Boron (NdFeB or NIB).

Figure 4:
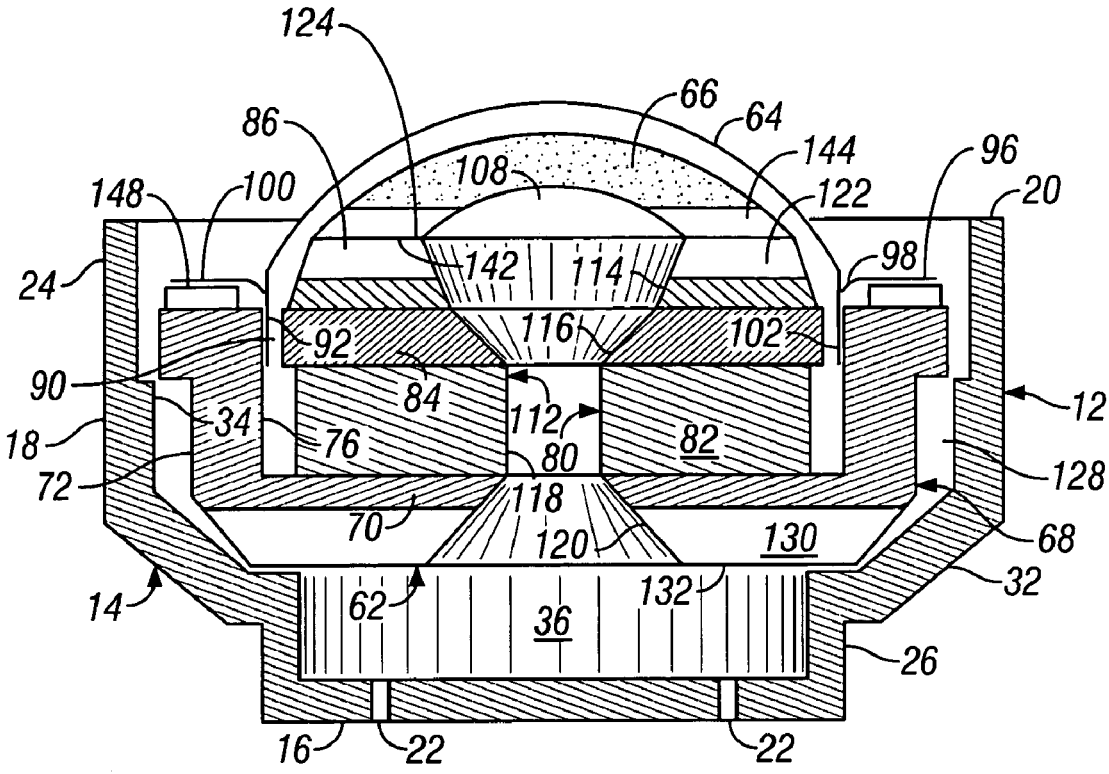
FIG. 4 is an enlarged side sectional view of the tweeter of FIG. 1 with the mounting flange and grill removed to better illustrate the lateral venting system.

As seen in FIG. 1 and also in FIG. 4, the size of the first magnet 82 and the top plate 84 is selected to provide an annular gap 90 extending therearound adapted to receive a voice coil assembly 92 (shown only in FIG. 4). As seen in FIG. 4, in this embodiment of the tweeter 10 the diaphragm 64 is domed and is supported by a flexible surround 96 having an inner edge 98 attached to the periphery of the diaphragm and an outer edge 100 supportable on the open front end 20 of the housing 12.

The voice coil assembly 92 preferably comprises a cylindrical former 102 on which a conductor is supported. The conductor comprises a coil portion (not shown) supported on the former 102 and leads 104 (shown only in FIGS. 2 and 3) extending from the coil portion to connect the coil to a signal source (not shown). The upper edge of the former 102 is affixed to the surround 96 near or at its inner edge 98 so that the voice coil assembly 92 is operatively engaged with the diaphragm.

When the outer edge 100 of the surround 96 is supported on the open front end 20 of the housing 12, the diaphragm 64 is movably supported over the open end of the housing forming a forward air chamber 108 between the motor 62 and the diaphragm, and this air chamber is continuous with the annular gap 90. In addition, the voice coil assembly 92 is movably supported in the annular gap 90.

Thus, the voice coil assembly 92, the motor 62 and the diaphragm 64 are cooperatively adapted to reproduce high frequency sounds. As used herein, "high frequency" denotes a range between about 1000 Hz and about 22 kHz.

In accordance with the present invention, the motor 62 is characterized by an air passage extending therethrough and continuous with the forward air chamber 108. This air passage may take many forms. For example, it may be a single passage or comprise a plurality of passages; such passages may have different shapes and sizes and may be centrally located in the motor or positioned elsewhere. In the preferred embodiment shown herein, the air passage in the motor 62 comprises a single central passage 112 formed by a central bore 114 in the second magnet 86, a central bore 116 in the top plate 84, a central bore 118 in the first magnet 82, and a central bore 120 in the back panel 70 of the yoke 68, all these central passages being aligned.

The central air passage 112 through the motor 62 preferably will be in communication with the annular gap 90 around the motor. This communication may be provided by one or more radial air channels 122 or grooves in the upper surface 124 of the second magnet 86, as best seen in FIG. 7.

In addition to the air passage through the motor 62, the tweeter 10 comprises an air chamber 128 lateral to the motor 62 and between the motor and the sidewall 18 of the housing 12. Although the lateral chamber 128 may take different forms, a preferred shape is a single annular chamber formed by a space between the sidewall 18 of the housing and the sidewall 72 of the yoke 68.

Figure 8:
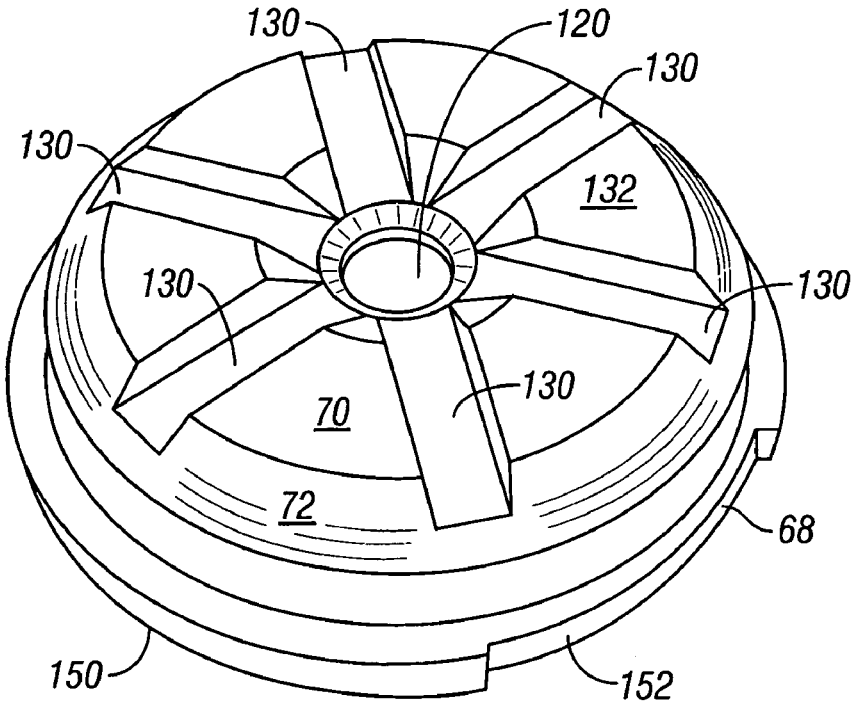
FIG. 8 is a rear perspective view of the back panel of the yoke of the motor showing the radial air channels thereon.
Figure 9:
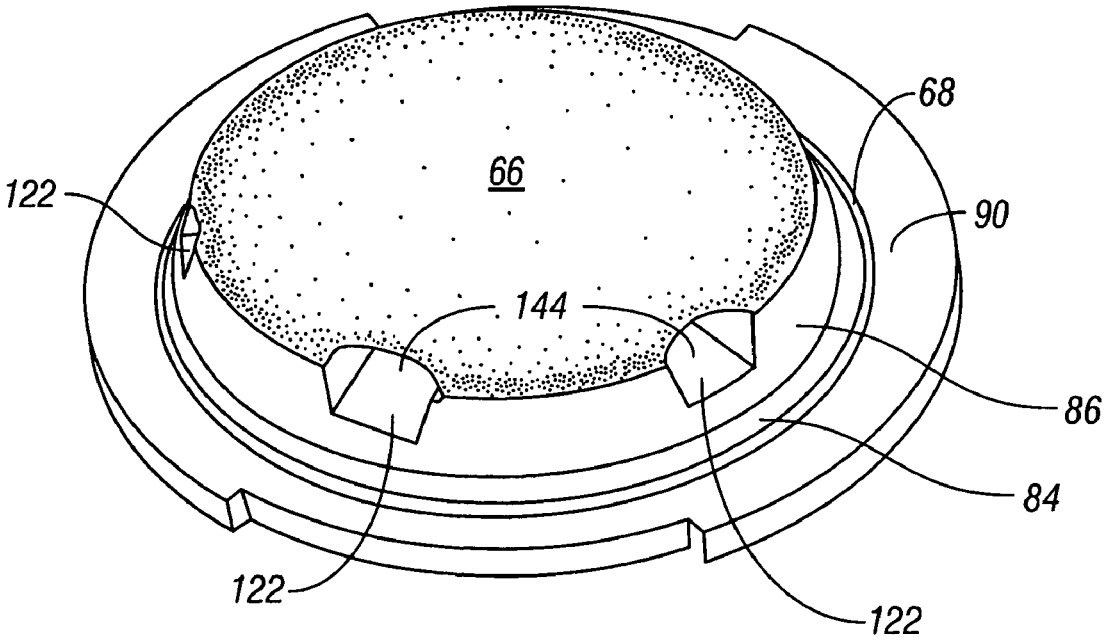
FIG. 9 is a frontal perspective view of the motor assembly in the housing with a damper or plug adhered to the top of the second magnet.

This lateral air chamber 128 communicates with the air passage 112 through the motor 62. To this end, one or more air channels are provided between the air passage 112 and the chamber 128. Preferably, the air channel comprises a plurality of radial channels 130 or grooves formed in the rear surface 132 of the back panel 70 of the yoke 68, as shown in FIG. 8.

As indicated, the tweeter 10 of this invention may include an acoustic damper or plug 66. In the tweeter 10, the acoustic damper is a dome-shaped plug formed of pressed polyfill. The plug 66 is sized to be supported on the upper surface 124 of the second magnet 86 and adapted to support the oscillating diaphragm 64. Ideally, the bottom 142 of the plug 66 is provided radial grooves 144 corresponding in size and position to the radial grooves 122 in the second magnet 86 to form part of the communicating passage between the central bore 112 in the motor 62 and the annular gap 90.

Having described the preferred structural components of the tweeter 10, one preferred method of assembly will be explained. First the motor 62 is assembled. The first magnet 82 is set inside the yoke 68 and the top plate 84 is placed on top of the first magnet. Then, the first magnet 82 is magnetized. Next, the second magnet 86 is magnetized and placed over the top plate 84. The plug 66 is glued to the top of the second magnet 86 aligning the grooves 144 in the plug with the grooves 122 in the second magnet 86.

Next, a washer 148 (FIG. 1) is glued to the top annular edge 150 of the yoke 68. The top edge of the coil former 102 is glued to the depending inner edge 98 of the surround 96, and glue is applied to the top of the washer 148. Then, the coil/surround assembly is positioned over the motor 62 with the coil former 102 in the annular gap 90 and the outer edge 100 of the surround 96 against the washer 148. The leads 104 are positioned in notches 152 on the outer aspect of the top edge 150 of the yoke 68, and through the lateral air chamber 128. Preferably, the housing 12 will have been formed with longitudinally placed lead grooves 154, as shown in FIG. 5 on opposing sides of the housing to accommodate the leads 104. The ends of the leads 104 are pulled through the openings 22 in the rear wall 16 of the housing 12. Epoxy is applied over the openings 22 to seal the housing and to fix the leads against the rear wall.

Having inserted the motor 62 and secured the leads 104, an inner flange ring 156 (FIG. 1) is glued over the top of the outer edge 100 of the surround 96. Finally, the grill 46 is inserted inside the mounting flange 36, and the grill/mounting flange assembly is screwed down over the threads 28 on the first body portion 24 of the housing 12. Now the tweeter 10 is ready for installation in a car or other vehicle, using the coaxial mounting cup 56, the flush mounting cup 58, or any other suitable mounting device.

In operation, the leads 104 from the tweeter 10 are connected to a signal source as part of the installation. Once the signal source is activated, current is supplied to the motor 62 causing reciprocal motion of the diaphragm. Movement of the diaphragm 64 moves the air mass inside the housing 12. This air mass occupies one continuous dampening enclosure 160 formed by the air gap 90, the radial passages formed by the grooves 144 in the plug 66 and the matching grooves 122 in the second magnet 86, the central air passage 112 through the motor 62, the grooves 130 in the back panel 70 of the yoke 68, the rear air chamber 36 in the rear or second portion 26 of the housing 12 behind the yoke 68, and the lateral air chamber 128 surrounding the motor. This significantly increases the volume of air that can be acted on by the diaphragm, thus enhancing the range and sound quality of the tweeter 10 without significantly increases its length.

Changes can be made in the combination and arrangement of the various parts and elements described herein without departing from the spirit and scope of the invention as defined in the following claims.

What is claimed is:

1. A tweeter comprising:

a housing comprising a rear wall and a sidewall, the sidewall extending forwardly from the rear wall and terminating in all open front end, and wherein the rear wall and sidewall form a motor receiving space;

a motor mounted in the motor receiving space of the housing, wherein the motor comprises a permanent magnet assembly and an annular gap extending around the permanent magnet assembly, wherein the motor is characterized by an air passage extending therethrough, wherein the motor comprises a yoke formed of a back panel and a sidewall extending forwardly of the back panel, the back panel and sidewall forming a magnet receiving space, wherein the magnet assembly comprises a first permanent magnet in the magnet receiving space of the yoke, a top plate receivable in the yoke over the first magnet, and a second permanent magnet positioned over the top plate, and wherein the at least one air passage through the motor comprises centrally positioned and aligned bores through the second magnet, the top plate, the first magnet and the back panel of the yoke;

a diaphragm movably supported over the open end of the housing and forming a forward air chamber between the motor and the diaphragm, wherein the forward air chamber is continuous with the air passage through the motor and the annular gap around the magnet assembly;

a voice coil assembly movably supported in the annular gap in the motor and operatively engaged with the diaphragm;

wherein the voice coil assembly, the motor and the diaphragm are cooperatively adapted to reproduce high frequency sounds;

an air chamber lateral to the motor and between the motor and the sidewall of the housing, and wherein the lateral air chamber is in communication with the air passage through the motor;

wherein the second permanent magnet comprises an upper surface defining a plurality of radially extending grooves connecting the annular gap and the air passage through the motor.

2. The tweeter of claim 1 wherein the back panel of the yoke comprises at least one channel connecting the air passage through the motor with the lateral air chamber.

3. The tweeter of claim 2 at least one air channel connecting the air passage through the motor with the lateral air chamber comprises a plurality of radially extending grooves on the rear surface of the yoke between the yoke and the rear wall of the housing.

4. The tweeter of claim 1 wherein the lateral air chamber comprises an annular chamber between the sidewall of the housing and the motor.

5. The tweeter of claim 1 further flexible surround having an inner edge attached to the diaphragm and an outer edge attached to the open front end of the housing.

6. The tweeter of claim 1 wherein the diaphragm is domed.

7. The tweeter of claim 6 further comprising an acoustic damper beneath the diaphragm.

8. The tweeter of claim 7 wherein the damper comprises a pressed polyfill plug.

9. The tweeter of claim 8 wherein the plug comprises radial grooves connecting the annular air gap in the motor with the air passage through the motor.

10. The tweeter of claim 1 wherein the voice coil assembly comprises a former and at least one conductor comprising a coil portion wound around the former and leads extending from the coil and connectable to a signal source.

11. A tweeter comprising:

a housing comprising a rear wall and a sidewall, the sidewall extending forwardly from the rear wall and terminating in an open front end, and wherein the rear wall and sidewall form a motor receiving space;

a motor mounted in the motor receiving space of the housing, wherein the motor comprises a permanent magnet assembly and an annular gap extending around the permanent magnet assembly, and wherein the motor is characterized by an air passage extending therethrough;

a domed diaphragm movably supported over the open end of the housing and forming a forward air chamber between the motor and the diaphragm, wherein the forward air chamber is continuous with the air passage through the motor and the annular gap around the magnet assembly;

an acoustic damper beneath the diaphragm, the damper comprising a pressed polyfill plug having radial grooves connecting the annular air gap in the motor with the air passage through the motor;

a voice coil assembly movably supported in the annular gap in the motor and operatively engaged with the diaphragm;

wherein the voice coil assembly, the motor and the diaphragm are cooperatively adapted to reproduce high frequency sounds;

an air chamber lateral to the motor and between the motor and the sidewall of the housing, and wherein the lateral air chamber is in communication with the air passage through the motor.

12. The tweeter of claim 11 wherein the motor further comprises:

a yoke formed of a back panel and a sidewall extending forwardly of the back panel, the back panel and sidewall forming a magnet receiving space;

wherein the magnet assembly comprises a first permanent magnet in the magnet receiving space of the yoke; and a top plate receivable in the yoke over the first magnet; and wherein the at least one air passage through the motor comprises centrally positioned and aligned bores through the top plate, the first magnet and the back panel of the yoke.

13. The tweeter of claim 12 wherein the magnet assembly comprises a second permanent magnet.

14. The tweeter of claim 13 wherein the second permanent magnet is positioned over the top plate.

15. The tweeter of claim 14 wherein the second permanent magnet comprises an upper surface defining at least one channel connecting the annular gap and the air passage through the motor.

16. The tweeter of claim 15 wherein the at least one air channel connecting the annular gap and the air passage through the motor comprises a plurality of radially extending grooves on the forward surface of the second magnet.

17. The tweeter of claim 16 wherein the back panel of the yoke comprises at least one channel connecting the air passage through the motor with the lateral air chamber.

18. The tweeter of claim 17 at least one air channel connecting the air passage through the motor with the lateral air chamber comprises a plurality of radially extending grooves on the rear surface of the yoke between the yoke and the rear wall of the housing.

19. The tweeter of claim 11 wherein the air passage through the motor comprises a single, centrally aligned passage through the motor.

20. The tweeter of claim 11 wherein the permanent magnet assembly comprises a second permanent magnet.

21. The tweeter of claim 11 wherein the lateral air chamber comprises an annular chamber between the sidewall of the housing and the motor.

22. The tweeter of claim 11 further flexible surround having an inner edge attached to the diaphragm and an outer edge attached to the open front end of the housing.

23. The tweeter of claim 11 wherein the motor comprises:

a yoke formed of a back panel and a sidewall extending forwardly of the back panel, the back panel and sidewall forming a magnet receiving space;

wherein the magnet assembly comprises a first permanent magnet in the magnet receiving space of the yoke; and a top plate receivable in the yoke over the first magnet.

24. The tweeter of claim 23 wherein the magnet assembly comprises a second permanent magnet.

25. The tweeter of claim 24 wherein the second permanent magnet is positioned over the top plate.

26. The tweeter of claim 11 wherein the voice coil assembly comprises a former and at least one conductor comprising a coil portion wound around the former and leads extending from the coil and connectable to a signal source.

* * * * *